United States Patent [19]

Kimura

[11] Patent Number: 4,618,150

[45] Date of Patent: Oct. 21, 1986

[54] GAME MACHINE WITH SELECTIVE STOP MEANS FOR MOVING DISPLAY

[75] Inventor: Yutaka Kimura, Tokyo, Japan

[73] Assignee: Kabushiki Kaisha Universal, Tochigi, Japan

[21] Appl. No.: 709,344

[22] Filed: Mar. 6, 1985

Related U.S. Application Data

[63] Continuation of Ser. No. 485,048, Apr. 14, 1983, abandoned.

[30] Foreign Application Priority Data

Apr. 14, 1982 [JP] Japan ..... 57-61000

[51] Int. Cl.[4] ..... A63B 71/04

[52] U.S. Cl. ..... 273/143 R; 273/138 A

[58] Field of Search ..... 273/138 A, 143 R, 1 E, 273/85 G, 139, 143 B, 143 C, 143 D, 143 E

[56] References Cited

U.S. PATENT DOCUMENTS

| | | | |
|---|---|---|---|
| 3,770,269 | 11/1973 | Elder | 273/138 A |
| 3,852,576 | 12/1974 | Rudd | 273/138 A |
| 4,095,795 | 6/1978 | Saxton et al. | 273/143 R |
| 4,240,635 | 12/1980 | Brown | 273/138 A |

FOREIGN PATENT DOCUMENTS

| | | | |
|---|---|---|---|
| 124298 | 8/1971 | United Kingdom | 273/143 R |
| 1348309 | 3/1974 | United Kingdom | 273/143 R |
| 2062923 | 5/1981 | United Kingdom | 273/143 R |

*Primary Examiner*—Richard C. Pinkham
*Assistant Examiner*—MaryAnn Stoll Lastova
*Attorney, Agent, or Firm*—Young & Thompson

[57] ABSTRACT

A game machine has indicia which indicate the proper time to control visible moving symbols. The indicia comprise lights or sounds to make a player recognize the proper time when predetermined prize-winning symbol or combination of symbols will occur on one or a plurality of rotatable reels in a stopped position of the reels as controlled by the player.

2 Claims, 4 Drawing Figures

GAME MACHINE WITH SELECTIVE STOP MEANS FOR MOVING DISPLAY

This application is a continuation of application Ser. No. 485,048, filed 4/14/83, now abandoned.

BACKGROUND OF THE INVENTION

The present invention relates to a game machine and particularly to an improved game machine which is adapted to give a player an indication of the proper time to operate an operating member for controlling moving visual symbols on reels.

A game machine, such as a slot machine, has three to five reels mounted individually rotatably, each said reel having an annular series of various symbols on its peripheral surface at regular intervals. In a slot machine having a plurality of reels with an annular series of various symbols on the peripheral surface of each reel, upon the respective reels stopping at random during each game to display various combinations of symbols, the machine detects predetermined prize-winning combinations of symbols to cause the release of different numbers of coins, tokens or the like in response to the occurrence of a predetermined prize-winning combination of symbols on the respective reels in the stopped position and to the occurrence of a specific symbol, for instance a picture of a cherry, on the leftmost reel in the stopped position. There have recently been proposed many kinds of TV-type slot machines with a CRT as a visual display screen for presenting a game. Such slot machines are adapted to present symbols analogous to those of a mechanical slot machine on the CRT screen, by simulating mechanical reels with an annular series of various symbols on the peripheral surface at regular intervals in states of rest and motion.

There are two types of ways to stop the reels. In one, the reels are automatically brought to a stop by means of a control circuit in the slot machine after a predetermined period of time. In the other, the reels can be stopped by operation of the player. In the latter type of slot machines there are provided stop button switches associated with the respective reels for stopping the reels individually. The slot machine, generally provided with three reels, is adapted to allow a bonus game when the arrangement of symbols of "BAR" on the respective reels occurs. The slot machine, in a bonus game, causes the pay out of a predetermined number of coins, tokens or the like in the case of an occurrence of the symbol of a cherry on any one of the reels as well as an occurrence of a predetermined combination of symbols.

In the slot machine mentioned above, since the occurrence of prize-winning symbols depends on the well-timed operations of the stop buttons, skilled players have many chances to win prizes, whereas there are limited chances for beginners.

OBJECT OF THE INVENTION

It is, accordingly, the principal object of the present invention to provide a game machine in which the occurrence of predetermined prize winning combinations of symbols can be easily obtained even by beginners.

SUMMARY OF THE INVENTION

The object of the present invention is accomplished with a game machine adapted to give, by means of sounds or light emitted from lamps, a player indications of the proper time to operate an operating member in order to successfully obtain an occurrence of a predetermined prize-winning symbol or combination of symbols.

DETAILED DESCRIPTION OF THE INVENTION

Figure 1:
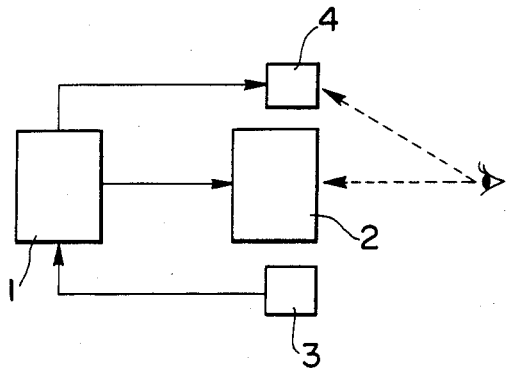
FIG. 1 is a schematic block diagram showing the principle of the present invention.

Referring now to the drawings in greater detail, wherein like reference numerals denote the same or similar elements or parts throughout the several views, in the broad outline of the present invention shown in FIG. 1, there is schematically shown a visual display screen 2 on which moving reels with symbols are successively displayed as visual images dependent on signals from a control device 1 controlling the whole game. The control device 1 can be stopped in operation by manipulating, for instance, push button switches on an operation board 3 while observing symbols continuously displayed on the display screen 2. Since the proper time for winning the game is indicated by an indicator 4, the player can operate the push button switches without missing an opportunity for winning. Lamps, sound speakers or the like are employed as the indicator 4.

As a result of this, the slot machine with the indicator can provide equal opportunities for winning a game to every player, since a player no longer needs experience or practice with the push button switches, thanks to the indicator 4.

Figure 2:
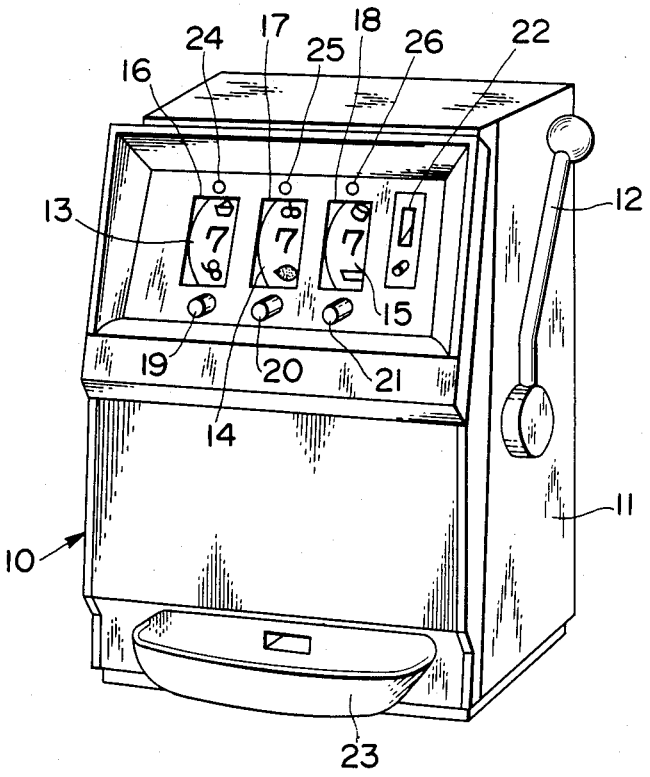
FIG. 2 is a perspective view showing a slot machine embodying the present invention.

FIG. 2 shows a slot machine embodying the present invention. The slot machine 10 has three reels 13 to 15 mounted individually rotatably on a shaft, each reel having an annular series of various symbols such as pictures of lemons, cherries or characters or numerals such as "SKILL·STOP", "BAR", "7" or the like on the peripheral surface thereof at regular intervals. These reels 13 to 15 are caused to rotate simultaneously by manipulation of a handle 12 provided on a side of a housing 11. Upon the respective reels stopping at random during each game, symbols on the reels 13 to 15 in stopped position are visible through windows 16 to 18 provided in the housing 11 of the slot machine, as is conventional in this art. These reels 13 to 15 are brought individually to a stop by touching stop button switches 19 to 21 associated with the respective reels with the player's finger. Above the windows 16 to 18 of the housing 11, lamps 24 to 26 are provided emitting signals such as the display of a light for giving a player an indication of the proper time to stop the respective reels.

To begin to play a game, the reels 13 to 15 are caused to rotate simultaneously by manipulation of the handle 12 after the insertion of coins, tokens or the like into the machine through a coin receiver 22 that causes a magnet or the like to release the locked handle 12. On the other hand, these reels 13 to 15 are brought individually to a stop by touching the respective switches 19 to 21 at the time when the lamps 16 to 18 respectively associated with the reels 13 to 15 are turned on one by one to emit light. The machine detects the stopped positions of the reels 13 to 15, thereby to determine whether a predetermined prize-winning combination of symbols has occurred on a specified winning line, for instance the central transverse line in this embodiment, and if so, to cause the pay out of different numbers of coins, tokens or the like in accordance with the types of combinations, into a coin saucer 23. Furthermore, the slot machine is adapted to pay out two coins, tokens or the like when a specified symbol, for instance a cherry, on the reel 13 has occurred on the winning line even though any other symbols on the other reels have occured on the same line. Moreover, the slot machine causes the pay out of an additional two coins, tokens or the like whenever the specified symbol, i.e. a picture of a cherry, on either the reel 14 or the reel 15 has occurred on the winning line.

In addition to said indication of the proper time which is given to a player at the moment when a predetermined prize-winning combination of symbols is occurring, it may be desirable to give a player an indication of the amount of the prize in accordance with the prize-winning combinations of symbols, in different forms, for instance, different colors of lamps, a lamp with variable brightness, or combinations of a plurality of other visible indicia. It is possible to use sounds in place of visible indicia.

Figure 3:
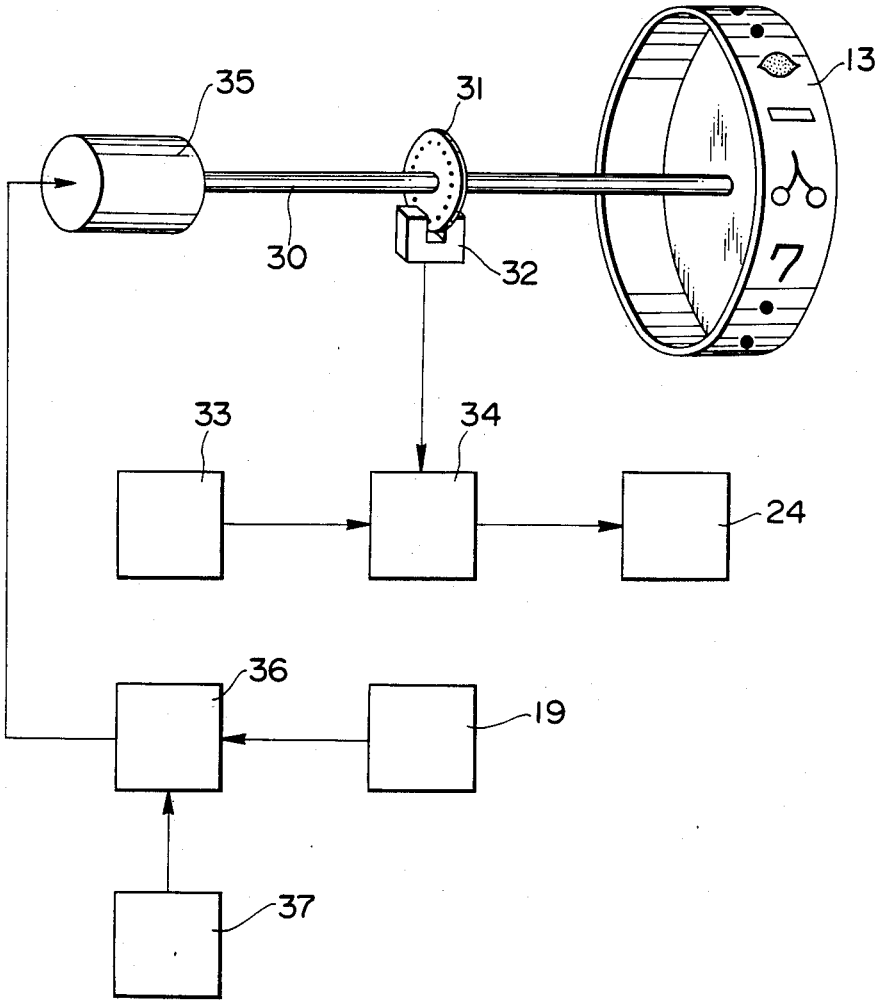
FIG. 3 is a block diagram showing an embodiment of an apparatus for detecting a predetermined winning symbol on a reel and displaying it.

FIG. 3 shows an essential part of the control device in the slot machine of FIG. 2. In FIG. 3, only the operation of the control device associated with the reel 13 is described, because the other reels operate identically.

Attached to a shaft 30 supporting the reel 13 is a position indicating disc 31 with which a pick-up device 32 cooperates in order to detect positions of the rotating reel 13. A signal of the position of the rotating reel 13 from the pick-up device 32 is compared with signals from a position memory 33 storing the information on positions at which prize-winning symbols are arranged on the reel 13, in a comparator circuit device 34. Upon the occurrence of an agreement between said signals, the indication lamp 24 flashes to make a player recognize the time of an occurrence of a predetermined prize-winning symbol on the reel 13.

The shaft 30 to which the reel 13 is attached is driven by means of a pulse motor 35 which is controlled by signals from a main controller 37, which controls the whole game throughout its duration, through a drive circuit device 36, but is stopped by a signal from a switch 19 operated according to the player's judgment. The proper time when the switch 19 should be operated to cause a prize-winning combination of symbols is given to the player by means of the lamp 24. One difference of the slot machine of the present invention from conventional slot machines is the provision of the position detecting means comprising elements 31 to 34, and the indication lamp 24.

Figure 4:
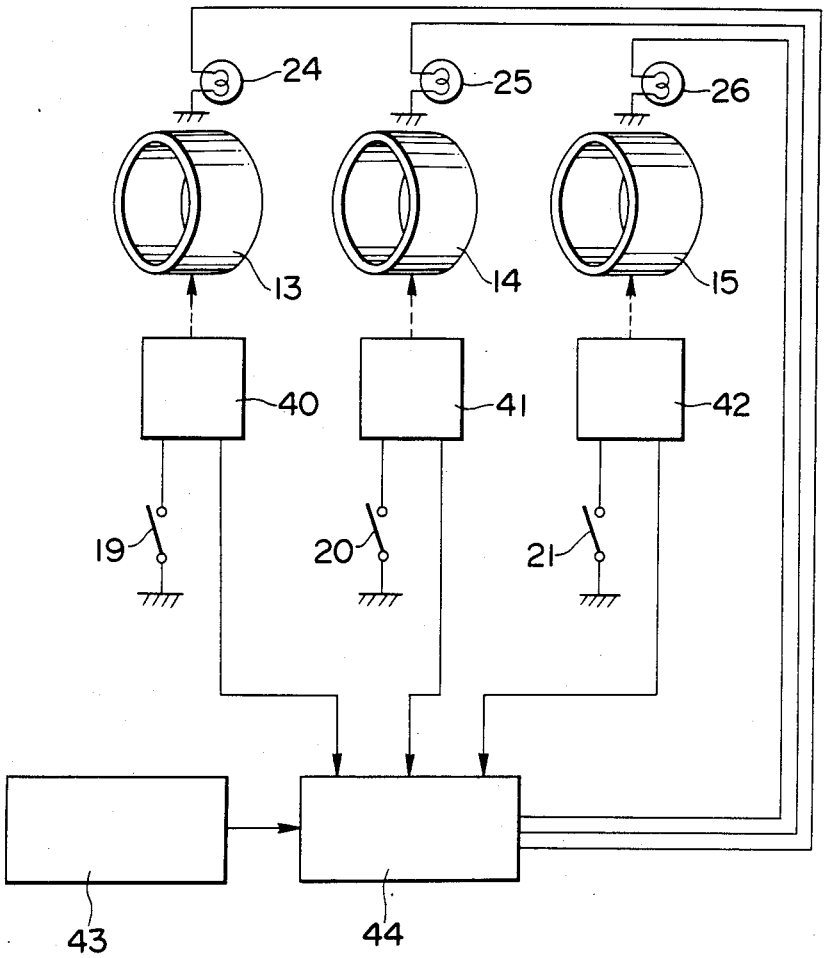
FIG. 4 is a block diagram showing an embodiment of an apparatus which is adapted to detect a combination of symbols on three reels in order to indicate the proper time to stop the respective reels.

Besides the occurrence of prize-winning symbols on the respective reels, there are various predetermined prize-winning combinations of symbols on the respective reels of the slot machine. An indication device, which gives a player an indication of the proper time for an occurrence of a predetermined prize-winning combination of symbols on the respective reels on a specified line, is described hereinafter in connection with FIG. 4.

The reels 13 to 15 are caused to rotate by control devices 40, 41 and 42 (each of which comprises the elements 31, 32, 35, 36 and 37 of FIG. 3), but are individually brought to a stop by push button switches 19 to 21 associated with the respective reels 13 to 15.

The position signals of the reels 13 to 15 are instantly compared with signals from a position memory 43, which memorizes the information as to various prize-winning combinations of symbols. Whenever an agreement between these signals occurs, indication lamps 24 to 26 flash to make the player recognize the proper time for the occurrence of a predetermined prize-winning combination of symbols on the respective reels. For example, after the stop button switch 19 is pushed to stop the reel 13 according to the flashing of the indication lamp 24, the indication lamps 25 and 26 will flash individually at the moment when symbols, which form an arrangement of a predetermined prize-winning combination of symbols in combination with the symbol on the reel 13 in stopped position, occur on the other two reels 14 and 15. At the time when the indication lamp 25 flashes, the stop button switch 20 is pushed to stop the reel 14. Consequently, the indication lamp 26 can flash only at the moment when a symbol, which forms a predetermined prize-winning combination of symbols in combination with the symbols on the reels 13 and 14 in stopped position, occurs on the reel 15, giving a player indication of the proper time to push the stop button switch 21 to cause the occurrence of a predetermined prize-winning combination of symbols. It is of course to be understood that the indication lamp 26 does not flash if the symbols on the reels 13 and 14 in stopped position do not accord with any one of the predetermined combinations of symbols. That the stop button switches 19 to 21 can be pushed at random without any hindrance is easily understood from the fact that there is nothing but the comparator circuit device 44 to cause the indication lamps 24 to 26 to emit light by comparing each symbol on the respective reel in stopped position with any one of the predetermined prize-winning combinations of symbols previously memorized in the memory 43. The combination of the comparator circuit device 44 and the position memory 43 can be replaced by a microcomputer having a read only memory (ROM) therein. In this case, an indication of the proper time to stop the respective reels may be accomplished by using a closed loop program in such a way that the information as to a combination of symbols on the rotating reels repeatedly fed thereto is compared with the information as to the predetermined prize-winning combinations of symbols memorized in the ROM so as to cause the indication lamps 24 to 26 to flash only upon an agreement between them occurring.

Although the above description is given for a slot machine embodying the present invention, the present invention is applicable to TV-type game machines such as missile games in which missiles or the like are launched on a viewing screen upon pushing buttons, and to roulette-type game machines wherein lamps arranged in a circle and corresponding to symbols are turned on one by one to flash in a predetermined order and which is adapted to interrupt the turning on of the lamp at a time corresponding to the advent of a predetermined prize-winning symbol.

In view of the foregoing disclosure, therefore, it will be apparent that the initially-recited object of the invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a game machine having player-actuated stop means for selectively stopping a plurality of sets of visible moving symbols, each set of symbols moving through a repeating cycle, said stop means comprising a stop button individual to each said set, the improvement comprising: means for detecting the position of each of said plurality of sets of visible moving symbols; and indicating means individual to each of said plurality of sets of visible moving symbols, said indicating means being responsive to said detecting means and operating once each said cycle to indicate to a player the proper time interval for stopping each of said plurality of sets of visible moving symbols so as to correspond to a winning position thereof.

2. A game machine as claimed in claim 1, wherein said indication means comprises a light individual to each of said plurality of sets of visible moving symbols, said light flashing each said cycle.

* * * * *